US006152829A

United States Patent [19]

Jaidka

[11] Patent Number: 6,152,829

[45] Date of Patent: Nov. 28, 2000

[54] DEVICE AND PROCESS FOR PRODUCING EFFECTS

[75] Inventor: Sandeep Jaidka, New Delhi, India

[73] Assignee: National Research Development Corp., New Delhi, India

[21] Appl. No.: 09/310,963

[22] Filed: May 13, 1999

[30] Foreign Application Priority Data

May 13, 1998 [IN] India ..... 2018/DEL/97

[51] Int. Cl.[7] ..... A63G 31/00

[52] U.S. Cl. ..... 472/65; 472/74

[58] Field of Search ..... 472/61, 64, 65, 472/74, 81; 40/428; 434/217

[56] References Cited

U.S. PATENT DOCUMENTS

| | | | |
|---|---|---|---|
| 3,628,829 | 12/1971 | Hellig | 297/217 |
| 4,771,344 | 9/1988 | Fallacaro et al. | 358/335 |
| 5,826,357 | 10/1998 | Hechler | 40/428 |

*Primary Examiner*—Kien T. Nguyen
*Attorney, Agent, or Firm*—Venable; George H. Spencer; Catherine M. Voorhees

[57] ABSTRACT

A device and a process for producing effects of waterfall, rain, garden, mountains, desert, animals, kitchen and river scenes while viewing a picture, an advertisement or playing amusement games in a cinema hall/open theater/TV is disclosed. The device includes a movie film/video tape/disc with coded signals for producing effects of waterfall, rain, garden, mountain, desert, animals, kitchen and river scenes or advertisements either recorded separately or embedded on the sound signals; an electronic decoder for decoding the coded signals when the film is moving and particular scene appears; the output of the electronic decoder is connected to an actuating device that releases gas/perfumes or energizes a heating/cooling device to produce the desired effects corresponding to the scene appearing on the screen. The process includes recording the coded signals for producing effect of waterfall, rain, garden, mountain, desert, animals, kitchen and river scenes or advertisement either separately or embedded on the sound signals on the movie film/video tape; decoding the coded digital signals when the film/tape is moving when a particular scene appears; and releasing gas/perfumes or energizing a heating/cooling device to produce the desired effects corresponding to the scene appearing on the screen. The coded signals are either analog or digital and include an idle signal.

17 Claims, 3 Drawing Sheets

(OPEN AIR THEATER)

DEVICE AND PROCESS FOR PRODUCING EFFECTS

FIELD OF THE INVENTION

This invention relates to a device and a process for producing effects of waterfall, rain, garden, mountains, desert, animals, kitchen and river scenes while viewing a picture, an advertisement or playing amusement games in a cinema hall/open theater/TV.

BACKGROUND OF THE INVENTION

In today's world of cinema/moving films a lot has been done in movies to provide real effects to the viewers like audio effects, visual effects and motion effects to indicate movements.

SUMMARY OF THE INVENTION

With this invention the viewers of the movie can find themselves in the same environment as the scene of the moving film which is playing, like if the scene of a mountain is shown the cooling effect in the enclosed space will increase, if deserts are shown then the heating effect will simultaneously increase. Similarly, if a moving scene of a garden is shown, one can smell the essence of flowers which can be released from a container or if rain is shown, one can smell the freshness of ozone and the like.

This invention is based on virtual reality of the moving film so that the viewers can feel themselves in the same environment as shown in the moving film.

OBJECT OF THE INVENTION

The object of this invention is to deliver the special equivalent environmental effect as depicted in the scene or advertisement recorded on the frame of the movie film or a video cassette/disc.

DESCRIPTION OF THE INVENTION

To achieve the above objective this invention provides a device for producing effects of waterfall, rain, garden, mountains, desert, animals, kitchen and river scenes while viewing a picture, an advertisement or playing amusement games in a cinema hall/open theater/TV comprising:

- movie film/video tape with coded signals for producing effects of waterfall, rain, garden, mountain, desert, kitchen and river scenes or advertisements either recorded separately or embedded on the sound signals;
- an electronic decoder for decoding the coded signals when the film is moving and a particular scene appears and;
- activating means connected to an output of the electronic decoder to release gas/perfume or energize heating/cooling means to produce the desired effects corresponding to the scene appearing on the screen.

The coded signals including an idle signal are either analog or digital signals and are coded against each of the desired scenes.

The said coded signals is a digital signal and the number of bits to be used in the digital coded signals are depend upon the number of effects to be produced in the cinema hall/open theater/TV.

The coded signal is an analog signal in the form of frequency or amplitude or phase modulation or any combination thereof.

The number of bits in the digital coded signals are 2 bits to produce four digital signals viz. 00, 01, 10 where 11 and 00 is an idle coded signal and the remaining three signals produce any three effects.

The number of bits in the digital coded signals are 3 bits to produce eight digital signals viz. 000, 001,010, 011, 100, 101, 110, 111 where 000 is an idle coded signal.

The number of bits in the digital coded signals are 4 bits to produce sixteen digital signals viz. 0000, 0001, 0010, 0100, 1000, 1001, 1010, 1100, 0011, 0101, 0110, 1101, 1110, 1011, 0111, 1111 where 0000 is an idle coded signal.

The activating means is a solenoid for opening of a gas container to produce the desired effect or it is a motor or a relay or any other known means for switching on heating/cooling means or any container for releasing the gas/perfume.

Process for producing effects of waterfall, rain, garden, mountains, desert, animals, kitchen and river scenes while viewing picture, advertisement or playing amusement games in a cinema hall/open theater/TV comprising:

- recording the coded signals for producing the effect of waterfall, rain, garden, mountain, desert, animals, kitchen and river scenes or advertisements either separately or embedded on the sound signals on the movie film/video tape;
- decoding the coded signals when the film/tape is moving when a particular scene appears and;
- releasing gas/perfume or energizing heating/cooling means to produce the desired effects corresponding to the scene appearing on the screen.

The coded signal including an idle signals are either analog or digital signals and are recorded against each desired scene.

The coded signal is an analog signal in the form of frequency or amplitude or phase modulation or any combination thereof.

The coded signal is a digital signal and the number of bits to be used in the digital coded signals depends upon the number of effects to be produced in cinema hall/open theatre/TV.

DETAILED DESCRIPTION OF THE INVENTION

Figure 1:
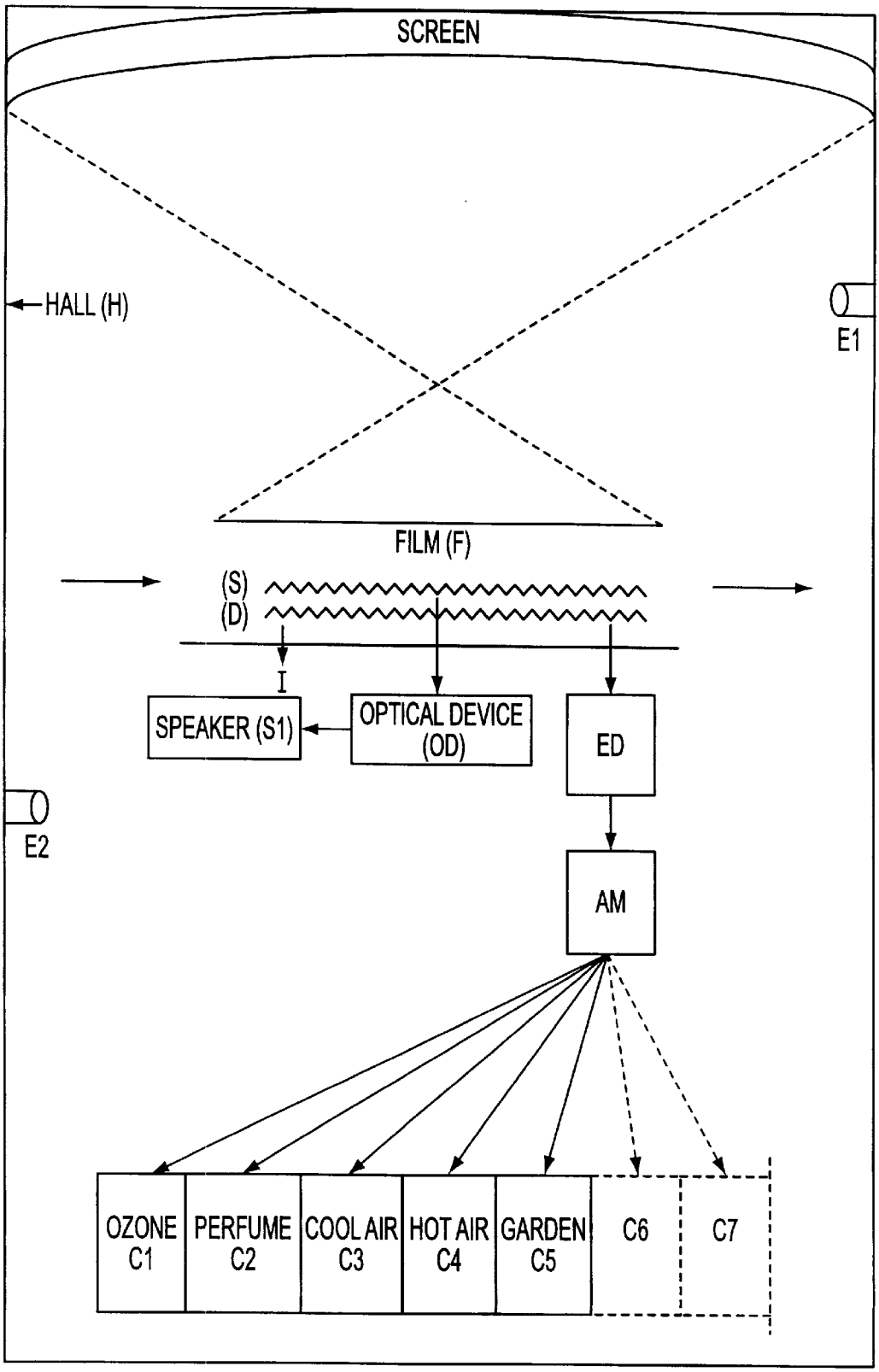
FIG. 1 illustrates the invention in a closed theater where the coded signals and the sound signals are separately recorded on the film (F)/Video Tape.

Referring to the FIG. 1 film (F)/video tape has sound signals (S) and coded signals (D). The coded signal (D) has an idle code (I). When the film (F) is moving and a particular scene, say, a rain scene appears on the screen in a cinema hall, the coded signal (D) is sensed by the electronic decoder (ED) which is connected to actuating means (AM) for releasing the gas/perfume from the containers (C1, C2) or energizing the heating/cooling means (C3, C4 etc.) to produce the desired effects in the hall. The hall has the exhaust vents (E1) and (E2).

Figure 2:
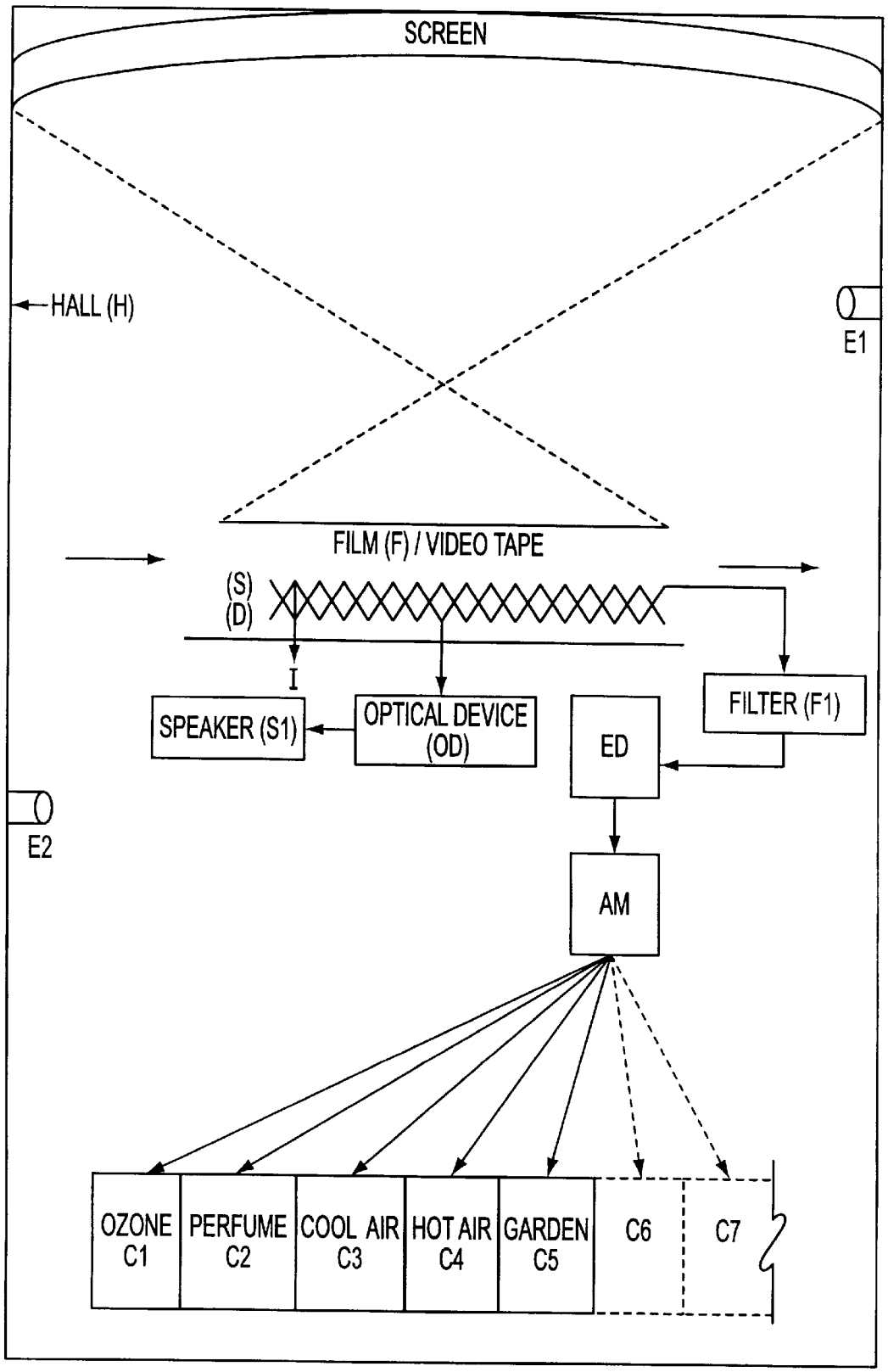
FIG. 2 illustrates the invention in a closed theater where the coded signal is embedded with the sound signal.

Referring to FIG. 2, the film (F)/video tape has coded signal embedded on the sound signal. The coded signal (D) has an idle code (I). When the film (F) is moving and a particular scene, say, a rain scene appears on the screen in a cinema hall, the coded signal (D) is sensed by the electronic decoder (ED) after sound signals are filtered through filter (F1) which is connected to actuating means (AM) for releasing the gas/perfume from the containers (C1, C2) or energize the heating/cooling means (C3,C4 etc.) to produce the desired effects in the hall.

The hall has exhaust vents (E1) and (E2). The idle code (I) functions only if the earlier effect has not been exhausted through vents (E1) and (E2).

Figure 3:
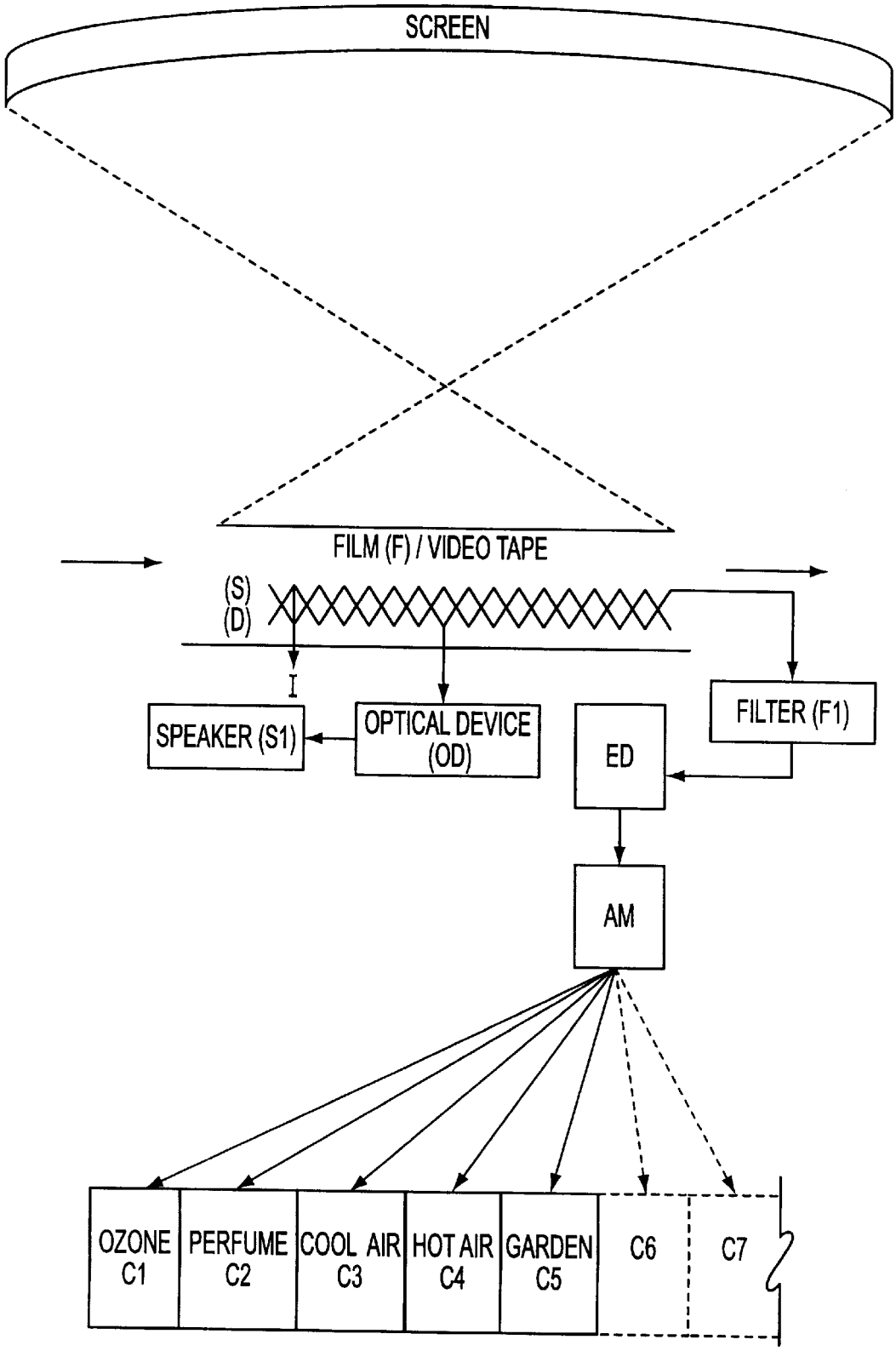
FIG. 3 explains the invention in an open theater where the coded signal is embedded with the sound signal.

Referring to FIG. 3, in an open air theater, the film (F)/video tape has a coded signal embedded on the sound signal. The coded signal (D) has an idle code (I). When the film (F) is moving and a particular scene, say, a rain scene appears on the screen, the coded signal (D) is sensed by the electronic decoder (ED) after sound signals are filtered through filter (F1) which is connected to actuating means (AM) for releasing the gas/perfume from the containers (C1, C2) or energize the heating/cooling means (C3, C4 etc.) to produce the desired effects in the hall. The open air theater does not require exhausts vents (E1) and (E2). The idle code (I) functions only if the earlier effect has not been exhausted from the open air theater.

The actuating means can be a motor or a relay for energizing the heating/cooling means. It can be a perfume or ozone gas for producing the rain effect. The perfume is meant for giving the effect of the flowers in the garden. The idle code is provided in the coded signals for idling the actuating means till the first effect, say a rain scene releasing ozone gas has been exhausted through exhausts vents (E1) & (E2).

The optical device (OD) converts the sound signal to produce sound from the sound signals recorded on the film/tape.

The above invention can be used even with the video cassettes/disc in the drawing room in the house and also while playing amusement games by providing the above arrangements.

Thus, the present invention includes the human sense of smelling different smells/aromas and feeling different temperatures, climate, wind etc., for example, if a chocolate advertisement is shown in a movie hall viewers can smell chocolate flavored air, or a particular brand of perfume can be smelled or for creating the effect of wind an air blower is used.

According to an option the device can work with remote control means. Further the device can be used in an auditorium wherein live drama/show is being staged.

The above invention includes any modification of the above invention including mechanical means in place of the described electronic means.

What is claimed is:

1. A device for producing effects of at least one of waterfall, rain, garden, mountains, desert, animals, kitchen and river scenes while viewing a picture, an advertisement or playing amusement games in a cinema hall/open theater/TV comprising:

movie film/video tape/disc with coded signals for producing effects of at least one of waterfall, rain, garden, mountain, desert, kitchen and river scenes of advertisements, said coded signals either recorded separately or embedded on the sound signals;

an electronic decoder for decoding said coded signals when said effect is to be expressed or a particular scene appears; and actuating means connected to an output of the electronic decoder for releasing gas/perfumes or energizing heating/cooling means to produce the desired effects corresponding to the scene appearing on a screen of the cinema hall/open theater/TV.

2. The device as claimed in claim 1 wherein said coded signal is either an analog or a digital signal and is coded by the side of a desired scene.

3. The device as claimed in claim 2 wherein said coded signal is an analog signal in the form of frequency or amplitude or phase modulation or any combination thereof.

4. The device as claimed in claim 1 wherein said coded signals have an idle coded signal for idling the actuating means until the earlier effect has been exhausted from said cinema hall/open theater/TV.

5. The device as claimed in claim 1 wherein the coded signal is a digital signal and the number of bits to used in the said digital coded signals depend upon the number of effects to be produced in the cinema hall/open theater/TV.

6. The device as claimed in claim 5 wherein the number of bits in the coded signals are 2 bits to produce four coded signals where one of the four coded signals is an idle coded signal and the remaining three signals produce any three effects.

7. The device as claimed in claim 5 wherein the number of bits in the coded signals are 3 bits to produce eight coded signals where one of the eight coded signals is an idle coded signal.

8. The device as claimed in claim 5 wherein the number of bits in the coded signals are 4 bits to produce sixteen coded signals where one of the sixteen coded signals is an idle coded signal.

9. The device as claimed in claim 1 wherein the actuating means is a solenoid for opening of a gas container to produce the desired effect.

10. The device as claimed in claim 1 wherein the actuating means is a motor or a relay for switching on a heater or cooling means of the heating/cooling means.

11. A process for producing effects of at least one of waterfall, rain, garden, mountains, desert, animals, kitchen and river scenes while viewing a picture, an advertisement or playing amusement games in a cinema hall/open theater/TV comprising:

recording coded signals for producing effects of one of waterfall, rain, garden, mountain desert, animals, kitchen and river scenes or advertisements either separately or embedded on sound signals on a movie film/video tape;

decoding said coded digital signals while said film/tape is moving when a particular scene appears; and releasing gas/perfume or energizing the heating/cooling means in response to the decoded digital signals to produce the desired effects corresponding to the scene appearing on a screen of the cinema/hall open theater/TV.

12. The process as claimed in claim 11 wherein the recording step additionally records analog signals that are coded against each desired scene.

13. The process as claimed in claim 12 wherein the recording step records analog signals in the form of frequency or amplitude or phase modulation or any combination thereof.

14. The process as claimed in claim 11 wherein the recording step includes recording said coded signal with an idle coded signal for idling the actuating means until an earlier effect has been exhausted from the cinema hall/open theater/TV.

15. The process as claimed in claim 11 wherein the recording step records coded digital signals with a predetermined number of bits and the number of bits in said digital coded signals depends upon the number of effects to be produced in the cinema hall.

16. The process as claimed in claim 11 wherein the recording step records additional digital signals that are coded against each desired scene.

17. A device for producing effects of one of waterfall, rain, garden, mountain, desert, animals, kitchen and river scenes while viewing a picture, advertisement or playing amusement games on a screen in one of a cinema hall, open theater and TV, said device comprising:

a movie film/video tape/disc with coded signals for producing effects of one of waterfall, rain, garden, mountain, desert, animals, kitchen and river scenes, said coded signals either recorded separately or embedded on the sound signals of the movie film/video tape/disc;

an electronic decoder for decoding said coded signals when said film is moving and a particular scene appears; and actuating means connected to an output of said electronic decoder for releasing gas/perfumes or energizing heating/cooling means to produce the desired effects corresponding to the scene appearing on the screen wherein said coded signals have an idle coded signal for idling the actuating means until an earlier effect has been exhausted from one of the cinema hall, open theater or television viewing area.

* * * * *